US010510291B2

(12) United States Patent
Huang et al.

(10) Patent No.: US 10,510,291 B2
(45) Date of Patent: Dec. 17, 2019

(54) DISPLAY METHOD AND DISPLAY DEVICE

(71) Applicant: BOE TECHNOLOGY GROUP CO., LTD., Beijing (CN)

(72) Inventors: Chienpang Huang, Beijing (CN); Chengte Lai, Beijing (CN); Weilin Lai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/765,501

(22) PCT Filed: Sep. 30, 2017

(86) PCT No.: PCT/CN2017/104916

§ 371 (c)(1),
(2) Date: Apr. 3, 2018

(87) PCT Pub. No.: WO2018/157597

PCT Pub. Date: Sep. 7, 2018

(65) Prior Publication Data

US 2019/0073947 A1 Mar. 7, 2019

(30) Foreign Application Priority Data

Mar. 1, 2017 (CN) ..... 2017 1 0117169

(51) Int. Cl.
*G09G 3/3225* (2016.01)
*G09G 3/36* (2006.01)

(52) U.S. Cl.
CPC ..... *G09G 3/3225* (2013.01); *G09G 3/3648* (2013.01); *G09G 2330/027* (2013.01); *G09G 2330/04* (2013.01)

(58) Field of Classification Search
CPC ..... G09G 3/3225; G09G 3/3648; G09G 2330/04; G09G 2330/027
See application file for complete search history.

(56) References Cited

U.S. PATENT DOCUMENTS

2010/0026673 A1* 2/2010 Cheng ..... G09G 3/3648 345/211
2011/0050552 A1 3/2011 Miyazaki et al.
(Continued)

FOREIGN PATENT DOCUMENTS

CN 101101385 A 1/2008
CN 101408699 A 4/2009
(Continued)

OTHER PUBLICATIONS

International Search Report and Written Opinion for Application No. PCT/CN2017/104916, dated Nov. 28, 2017, 9 Pages.
(Continued)

*Primary Examiner* — Abbas I Abdulselam
(74) *Attorney, Agent, or Firm* — Brooks Kushman P.C.

(57) ABSTRACT

A display method for a display device and the display device are provided. The display device includes multiple gate lines and multiple data lines, each of the gate lines extends in a row direction, and each of the data lines extends in a column direction. The method includes: dividing a display region of the display device into multiple sub-regions, where each of the sub-regions includes all of the data lines in the row direction and includes at least one of the gate lines in the column direction; controlling, when the display device is shut down or powered down, a gate driving circuit of the display device to input a turn-on voltage into the gate lines in each of the sub-regions one by one; and controlling a source driving circuit of the display device to input a voltage corresponding to a grayscale value of 0 to each of the data lines.

14 Claims, 3 Drawing Sheets

(56) References Cited

U.S. PATENT DOCUMENTS

| | | | | |
|---|---|---|---|---|
| 2011/0134035 | A1* | 6/2011 | Um | G08C 23/04 345/158 |
| 2013/0082994 | A1* | 4/2013 | Al-Dahle | G09G 3/3648 345/208 |
| 2013/0208199 | A1* | 8/2013 | Sakamoto | G02F 1/133555 349/33 |
| 2014/0340297 | A1* | 11/2014 | Oke | G09G 3/3666 345/103 |
| 2015/0042548 | A1 | 2/2015 | Liu et al. | |
| 2015/0077406 | A1 | 3/2015 | Lee et al. | |
| 2015/0206477 | A1 | 7/2015 | Xu | |
| 2015/0348507 | A1 | 12/2015 | Zhang et al. | |
| 2016/0275859 | A1 | 9/2016 | Tseng | |
| 2016/0275889 | A1* | 9/2016 | Yu | G09G 3/3648 |
| 2017/0032727 | A1 | 2/2017 | Lan et al. | |

FOREIGN PATENT DOCUMENTS

| | | | |
|---|---|---|---|
| CN | 101882416 | A | 11/2010 |
| CN | 103400546 | A | 11/2013 |
| CN | 103400555 | A | 11/2013 |
| CN | 103943064 | A | 7/2014 |
| CN | 203895097 | U | 10/2014 |
| CN | 104978942 | A | 10/2015 |
| CN | 105957483 | A | 9/2016 |
| CN | 107068081 | A | 8/2017 |

OTHER PUBLICATIONS

First Office Action for Chinese Application No. 2017101117169.9, dated Dec. 3, 2018, 7 Pages.

Second Office Action for Chinese Application No. 201710117169.9, dated May 24, 2019, 8 Pages.

* cited by examiner

DISPLAY METHOD AND DISPLAY DEVICE

CROSS-REFERENCE TO RELATED APPLICATION

This application is the U.S. national phase of PCT Application No. PCT/CN2017/104916 filed on Sep. 30, 2017, which claims priority to Chinese Patent Application No. 201710117169.9 filed on Mar. 1, 2017, which are incorporated herein by reference in their entireties.

TECHNICAL FIELD

The present disclosure relates to the field of display technology, in particular to a display method and a display device.

BACKGROUND

An image residual phenomenon tends to occur to a display device when the display device is powered down or abnormally powered off. In order to solve the above problem, in the related art, when the display device is powered off or abnormally powered down, a gate driving circuit is controlled to simultaneously input a normal turn-on voltage to each of gate lines, and a source driving circuit is controlled to input a voltage corresponding to a grayscale value of 0 to each of data lines, such that a whole display image is black. However, in a moment when the gate driving circuit simultaneously inputs the normal turn-on voltage to each of the gate lines, a large inrush current may be generated, which easily causes the gate driving circuit to be burned down.

SUMMARY

The present disclosure provides a display method and a display device, to prevent, when a display device is shut down or powered down abnormally, a gate driving circuit from a risk of being burned down caused by that the gate driving circuit is controlled to simultaneously input a normal turn-on voltage to each of gate lines.

The present disclosure provides a display method for a display device, wherein the display device comprises a plurality of gate lines and a plurality of data lines, each of the gate lines extends in a row direction, each of the data lines extends in a column direction. The display method comprises: dividing a display region of the display device into a plurality of sub-regions, wherein each of the sub-regions comprises all of the data lines in the row direction, and comprises at least one of the gate lines in the column direction; controlling, in the case that the display device is shut down or powered down, a gate driving circuit of the display device to input a turn-on voltage to the gate lines in each of the sub-regions one by one, wherein the turn-on voltage is simultaneously inputted into each of the gates lines in a same sub-region; and controlling a source driving circuit of the display device to input a voltage corresponding to a grayscale value of 0 to each of the data lines.

Optionally, the turn-on voltage is equal to another turn-on voltage inputted into the gate lines by the gate driving circuit in the case that the display device displays an image normally.

Optionally, the turn-on voltage is less than another turn-on voltage inputted into the gate lines by the gate driving circuit in the case that the display device displays an image normally.

Optionally, the turn-on voltage is a supply voltage of a chip of a driver integrated circuit.

Optionally, the number of the gate lines in any one of the sub-regions is the same as the number of the gate lines in any other one of the sub-regions, and the gate driving circuit is controlled such that a first time interval is equal to a second time interval, wherein the first time interval is an interval between a time for inputting the turn-on voltage to any one of the sub-regions and a time for inputting the turn-on voltage to a second one of the sub-regions adjacent to the one sub-region, and the second time interval is an interval between a time for inputting the turn-on voltage to any other one of the sub-regions other than the one sub-region and a time for inputting the turn-on voltage to a fourth one of the sub-regions adjacent to the other one sub-region.

Optionally, the turn-on voltage is sequentially inputted into the gate lines of the sub-regions from top to bottom.

Optionally, the turn-on voltage is sequentially inputted into the gate lines of the sub-regions from bottom to top.

The present disclosure further provides a display device, comprising: a plurality of gate lines and a plurality of data lines, wherein each of the gate lines extends in a row direction, each of the data lines extends in a column direction, and the display device further comprises: a dividing module, configured to divide a display region of the display device into a plurality of sub-regions, wherein each of the sub-regions comprises all of the data lines in the row direction, and comprises at least one of the gate lines in the column direction; a first controlling module, configured to control, in the case that the display device is shut down or powered down, a gate driving circuit of the display device to input a turn-on voltage to the gate lines in each of the sub-regions one by one, wherein the turn-on voltage is simultaneously inputted into each of the gates lines in a same sub-region; and a second controlling module, configured to control a source driving circuit of the display device to input a voltage corresponding to a grayscale value of 0 to each of the data lines.

Optionally, the turn-on voltage is equal to another turn-on voltage inputted into the gate lines by the gate driving circuit in the case that the display device displays an image normally.

Optionally, the turn-on voltage is less than another turn-on voltage inputted into the gate lines by the gate driving circuit in the case that the display device displays an image normally.

Optionally, the turn-on voltage is a supply voltage of a chip of a driver integrated circuit.

Optionally, the first controlling module is arranged in a chip of a driver integrated circuit, or arranged in a gate driving circuit in a form of a Gate driver On Array (GOA) circuit.

Optionally, the first controlling module is configured to control, in the case that the display device is shut down or powered down, the gate driving circuit of the display device to sequentially input the turn-on voltage into the gate lines of the sub-regions from top to bottom.

Optionally, the first controlling module is configured to control, in the case that the display device is shut down or powered down, the gate driving circuit of the display device to sequentially input the turn-on voltage into the gate lines of the sub-regions from bottom to top.

In the embodiments of the present disclosure, the display region of the display device is divided into the plurality of sub-regions, each of the sub-regions includes at least one of the gate lines, when the display device is shut down or powered down, the gate lines are turned on sequentially according to the sub-regions where the gate lines are located, and the voltage corresponding to a grayscale value of 0 is inputted into each of the data lines, so as to control subpixels in each of the sub-regions to display a black image one by one, thereby advoiding a residual image. Moreover, since the gate lines are turned on sequentially according to the sub-regions where the gate lines are located, an inrush current generated by the gate driving circuit becomes small, thereby preventing the gate driving circuit from being burned down.

DETAILED DESCRIPTION

In order to make the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Figure 1:
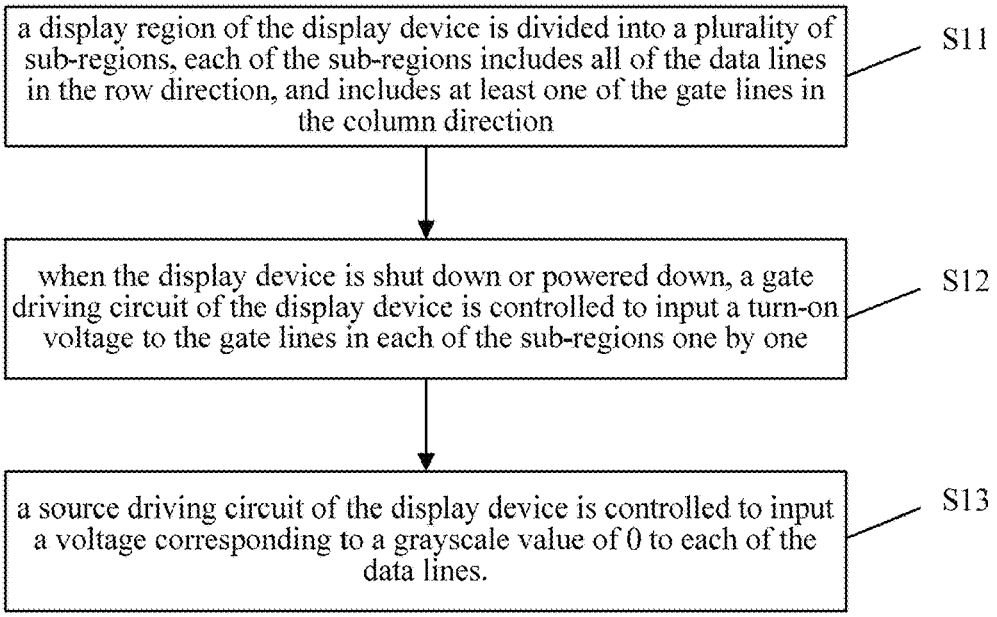
FIG. 1 is a flow chart of a display method according to some embodiments of the present disclosure.

Reference is made to FIG. 1, which is a flow chart of a display method according to some embodiments of the present disclosure. The display method is applied to a display device, the display device includes a plurality of gate lines and a plurality of data lines, each of the gate line extends in a row direction, each of the data lines extends in a column direction, and a plurality of subpixels are arranged in a pixel region defined by the gate lines and the data lines. The display method includes steps S11 to S13.

In step S11, a display region of the display device is divided into a plurality of sub-regions, and each of the sub-regions includes at least one of the gate lines.

Each of the sub-regions includes all of the data lines in the row direction, and includes at least one of the gate lines in the column direction, adjacent sub-regions do not overlap each other, and no gate line exists between the adjacent sub-regions.

In step S12, when the display device is shut down or powered down, a gate driving circuit of the display device is controlled to input a turn-on voltage to the gate lines in each of the sub-regions one by one.

That is, the gate driving circuit is controlled to input the turn-on voltage to each of the sub-regions one by one at a preset interval. In addition, the turn-on voltage is simultaneously inputted into all of the gates lines in one of the sub-regions when the turn-on voltage is inputted into the one region. That is, the gates lines belonging to the same sub-region are simultaneously turned on.

The turn-on voltage refers to a turn-on voltage for a switching Thin Film Transistor (TFT) connected with the gate line, and the operation of turning on the gate lines refers to turn on the switching TFT connected with the gate line.

In step S13, a source driving circuit of the display device is controlled to input a voltage corresponding to a grayscale value of 0 to each of the data lines.

After the voltage corresponding to a grayscale value of 0 is inputted, the subpixels corresponding to the gate lines having been turned on display a black image.

In the embodiments of the present disclosure, the display region of the display device is divided into a plurality of sub-regions, each of the sub-regions includes at least one of the gate lines, when the display device is shut down or powered down, the gate lines are turned on sequentially according to the sub-regions where the gate lines are located, and the voltage corresponding to a grayscale value of 0 is inputted into each of the data lines, so as to control the subpixels in each of the sub-regions to display a black image one by one, and thereby advoiding a residual image. Moreover, since the gate lines are turned on sequentially according to the sub-regions where the gate lines are located, an inrush current generated by the gate driving circuit becomes small, thereby preventing the gate driving circuit from being burned down.

In some embodiments of the present disclosure, optionally, the turn-on voltage is sequentially inputted into the gate lines in each of the sub-regions from top to bottom or from bottom to top of the display region.

In some embodiments of the present disclosure, optionally, the number of the gate lines in any one of the sub-regions is the same as the number of the gate lines in any other one of the sub-regions. Certainly, in other embodiments of the present disclosure, the numbers of the gate lines in different sub-regions may be different.

In some embodiments of the present disclosure, optionally, the gate lines in respective sub-regions are turned on at an identical time interval. For example, the time interval between the operation of turning on the gate lines in the first sub-region and the operation of turning on the gate lines in the second sub-region is 0.1 second, the time interval between the operation of turning on the gate lines in the second sub-region and the operation of turning on the gate lines in the third sub-region is 0.1 second, and so on. In some other embodiments of the present disclosure, the gate lines in respective sub-regions may be turned on at different time intervals.

In the above embodiment, when the display device is shut down or powered down, the turn-on voltage inputted into the gate lines by the gate driving circuit may be equal to another turn-on voltage inputted into the gate lines by the gate driving circuit when the display device displays an image normally. In this case, the original turn-on voltage is used without modifying the turn-on voltage. In a case that the switching TFT is a TFT of Negative-channel Metal-Oxide-Semiconductor (NMOS), the turn-on voltage inputted into the gate lines by the gate driving circuit when the display device displays an image normally is usually VGH, and a corresponding turn-off voltage is usually VGL. In a case that the switching TFT is a TFT of Positive-channel Metal-Oxide-Semiconductor (PMOS), the turn-on voltage inputted into the gate lines by the gate driving circuit when the display device displays an image normally is usually VGL, and a corresponding turn-off voltage is usually VGH.

In order to further decrease the inrush current generated by the gate driving circuit when the gate lines are turned on, optionally, the turn-on voltage inputted into the gate lines by the gate driving circuit when the display device is shut down or powered down may also be less than the turn-on voltage inputted into the gate lines by the gate driving circuit when the display device displays an image normally.

An example is taken below that when the turn-on voltage inputted into the gate lines by the gate driving circuit when the display device is shut down or powered down is less than the turn-on voltage inputted into the gate lines by the gate driving circuit when the display device displays an image normally.

Figure 2:
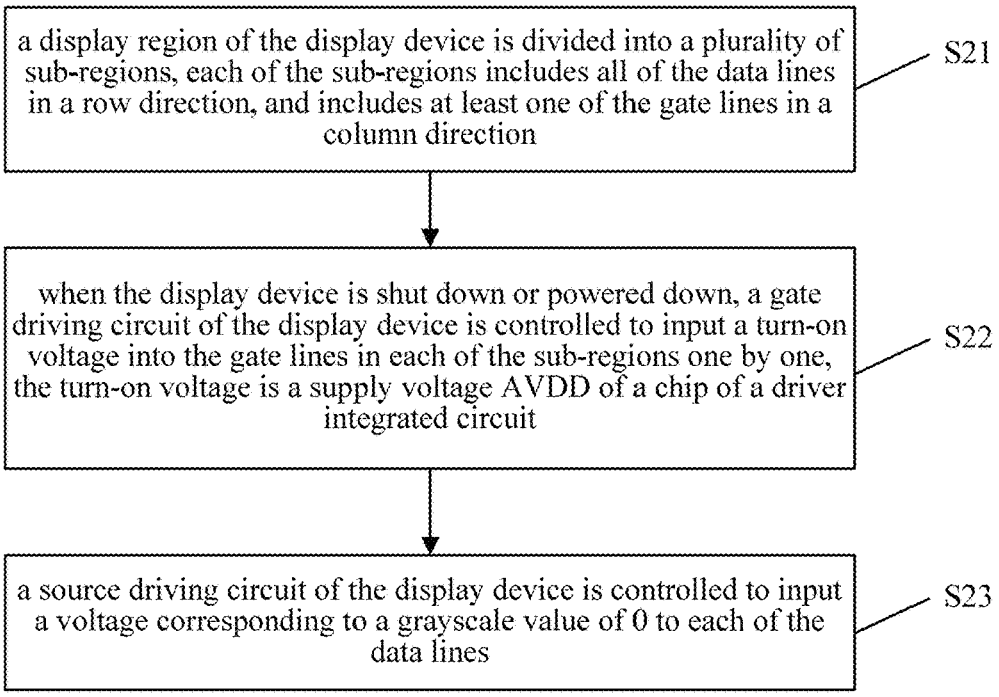
FIG. 2 is a flow chart of a display method according to some embodiments of the present disclosure.

Reference is made to FIG. 2, which is a flow chart of a display method according to some embodiments of the present disclosure. The display method is applied to a display device. The display device includes a plurality of gate lines and a plurality of data lines, a plurality of subpixels are arranged in a pixel region defined by the gate lines and the data lines, and the display method includes steps S21 to S23.

In step S21, a display region of the display device is divided into a plurality of sub-regions, and each of the sub-regions includes at least one of the gate lines. Each of the sub-regions includes all of the data lines in a row direction, and includes at least one of the gate lines in a column direction, the adjacent sub-regions do not overlap each other, and no gate line exists between the adjacent sub-regions.

In step S22, when the display device is shut down or powered down, a gate driving circuit of the display device is controlled to input a turn-on voltage into the gate lines in each of the sub-regions one by one. The turn-on voltage is a supply voltage AVDD of a chip of a driver integrated circuit, and the AVDD is less than another turn-on voltage inputted into the gate lines by the gate driving circuit when the display device displays an image normally. The voltage AVDD generally ranges from 5V to 6.5V.

In step S23, a source driving circuit of the display device is controlled to input a voltage corresponding to a grayscale value of 0 to each of the data lines.

In the embodiments of the present disclosure, when the display device is shut down or powered down, the turn-on voltage inputted into the gate lines by the gate driving circuit is equal to the supply voltage AVDD of the chip of a driver integrated circuit, and the voltage AVDD is less than the turn-on voltage inputted into the gate lines by the gate driving circuit when the display device displays an image normally, thereby further decreasing the inrush current generated by the gate driving circuit when the gate lines are turned on. In addition, the voltage AVDD is generated by the chip of the driver integrated circuit itself, and a driving capacity of the AVDD is strong.

A display device is further provided according to some embodiments of the present disclosure, which includes a plurality of gate lines and a plurality of data lines. The display device further includes: a dividing module, configured to divide a display region of the display device into a plurality of sub-regions, where each of the sub-regions includes all of the data lines in a row direction and includes at least one of the gate lines in a column direction, the adjacent sub-regions do not overlap each other, and no gate line exists between the adjacent sub-regions; a first controlling module, configured to control, when the display device is shut down or powered down, a gate driving circuit of the display device to input a turn-on voltage to the gate lines in each of the sub-regions one by one; and a second controlling module, configured to control a source driving circuit of the display device to input a voltage corresponding to a grayscale value of 0 to each of the data lines.

In the embodiments of the present disclosure, the display region of the display device is divided into the plurality of sub-regions, each of the sub-regions includes at least one of the gate lines. When the display device is shut down or powered down, the gate lines are turned on sequentially according to the sub-regions where the gate lines are located, and the voltage corresponding to a grayscale value of 0 is inputted into each of the data lines, so as to control subpixels in each of the sub-regions to display a black image one by one, thereby advoiding a residual image. Moreover, since the gate lines are turned on sequentially according to the sub-regions where the gate lines are located, an inrush current generated by the gate driving circuit becomes small, thereby preventing the gate driving circuit from being burned down.

In some embodiments of the present disclosure, when the display device is shut down or powered down, the turn-on voltage inputted into the gate lines by the gate driving circuit may be equal to a turn-on voltage inputted into the gate lines by the gate driving circuit when the display device displays an image normally. In this case, it is not required to modify the turn-on voltage, and the original turn-on voltage may be maintained.

In some embodiments of the present disclosure, the turn-on voltage inputted into the gate lines by the gate driving circuit when the display device is shut down or powered down is less than the turn-on voltage inputted into the gate lines by the gate driving circuit when the display device displays an image normally, which further decrease the inrush current generated by the gate driving circuit when the gate lines are turned on.

In some embodiments of the present disclosure, when the display device is shut down or powered down, the turn-on voltage inputted into the gate lines by the gate driving circuit is equal to a supply voltage AVDD of the chip of the driver integrated circuit, and the voltage AVDD is less than the turn-on voltage inputted into the gate lines by the gate driving circuit when the display device displays an image normally, thereby further decreasing the inrush current generated by the gate driving circuit when the gate lines are turned on. In addition, the voltage AVDD is generated by the chip of the driver integrated circuit itself, and a driving capacity of the AVDD is strong.

In some embodiments of the present disclosure, the first controlling module may be arranged in the chip of a driver Integrated Circuit (drive IC), or the gate driving circuit, wherein the gate driving circuit may be a GOA circuit.

In the embodiments of the present disclosure, the display device may be an Organic Light-Emitting Diode (OLED) display device or a liquid crystal display device. Further, the display device may be a flexible OLED display device.

Figure 3:
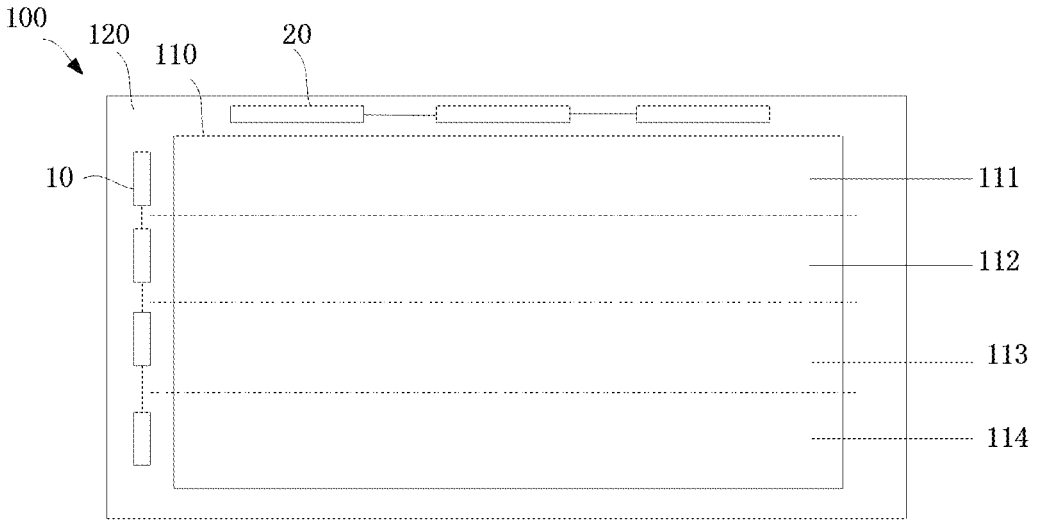
FIG. 3 is a structural schematic diagram of a display device according to some embodiments of the present disclosure.

Reference is made to FIG. 3. A display device 100 is further provided according to some embodiments of the present disclosure. The display device 100 includes a display region 110 and a non-display region 120, and the display region 110 is provided with a plurality of gate lines (each of the gate lines extending laterally, which is not shown in FIG. 3) and a plurality of data lines (each of the gate lines extending longitudinally, which is not shown in FIG. 3). The display region 110 is divided into four sub-regions (sub-region 111, sub-region 112, sub-region 113 and sub-region 114), each of the sub-regions includes a plurality of the gate lines, and the number of the gate lines in any one of the sub-regions is the same as the number of the gate lines in any other one of the sub-regions. For example, the display region 110 includes 2560 gate lines, and each of the sub-regions includes 640 gate lines. A gate driving circuit 10 and a source driving circuit 20 are arranged in the non-display region 20, the gate driving circuit 10 is connected with each of the gate lines, and the source driving circuit 20 is connected with each of the data lines.

Figure 4:
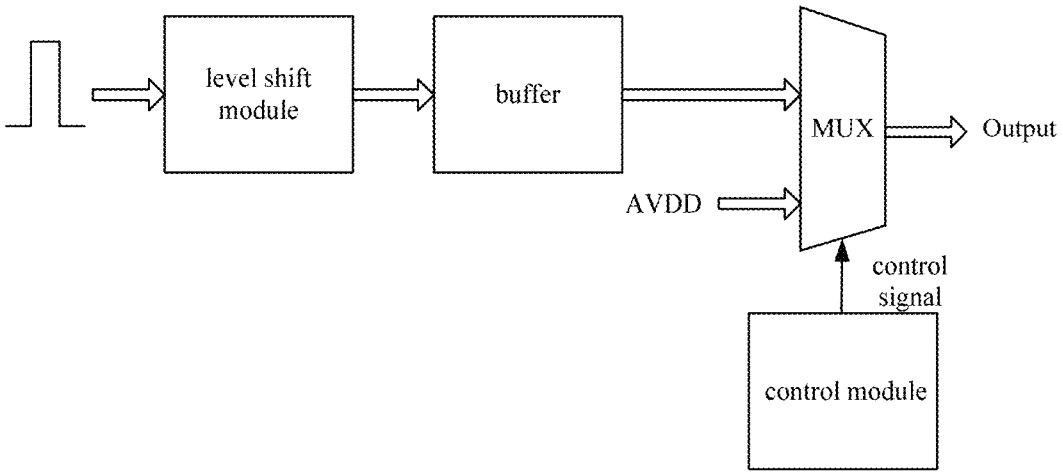
FIG. 4 is a structural schematic diagram of a driver integrated circuit according to some embodiments of the present disclosure.

In some embodiments of the present disclosure, the display device 100 further includes a driver integrated circuit. Reference is made to FIG. 4, which is a structural schematic diagram of a driver integrated circuit according to some embodiments of the present disclosure. The driver integrated circuit includes: a level shift module, a buffer, a multiplexer (MUX) and a controlling module. The MUX includes two input terminals and one output terminal, one of the input terminals is connected with the buffer and configured to receive a VGH voltage or VGL voltage inputted by the buffer, and the other one of the input terminals is configured to receive the inputted voltage AVDD. The MUX includes a switch, which is configured to switch a voltage outputted by the output terminal between a voltage of one of the input terminals and a voltage of the other one of the input terminals under the control of the controlling module. When the display device displays an image normally, the output terminal outputs the voltage VGH or the voltage VGL to the gate driving circuit 10. When the display device is shut down or powered down, the controlling module sequentially inputs control signals XAO1, XAO2, XAO3 and XAO4 to the MUX, and the MUX switches the voltage outputted by the output terminal to be the Voltage AVDD upon receipt of the control signals. That is, when the MUX receives the control signal XAO1, the Voltage AVDD is inputted to the sub-region 111; when the MUX receives the control signal XAO2, the Voltage AVDD is inputted to the sub-region 112; when MUX receives the control signal XAO3, the Voltage AVDD is inputted to the sub-region 113; and when MUX receives the control signal XAO4, the Voltage AVDD is inputted to the sub-region 114. A time interval between sequentially inputting any two adjacent ones of the four control signals (XAO1, XAO2, XAO3, and XAO4) to the MUX by the controlling module is the same as a time interval between sequentially inputting any two other adjacent ones of the four control signals to the MUX by the controlling module.

The driver integrated circuit further includes another controlling module (not shown in FIG. 4) configured to control, when the display device is powered on/off, the source driving circuit 20 to input a voltage corresponding to a grayscale value of 0 to each of the data lines.

Figure 5:
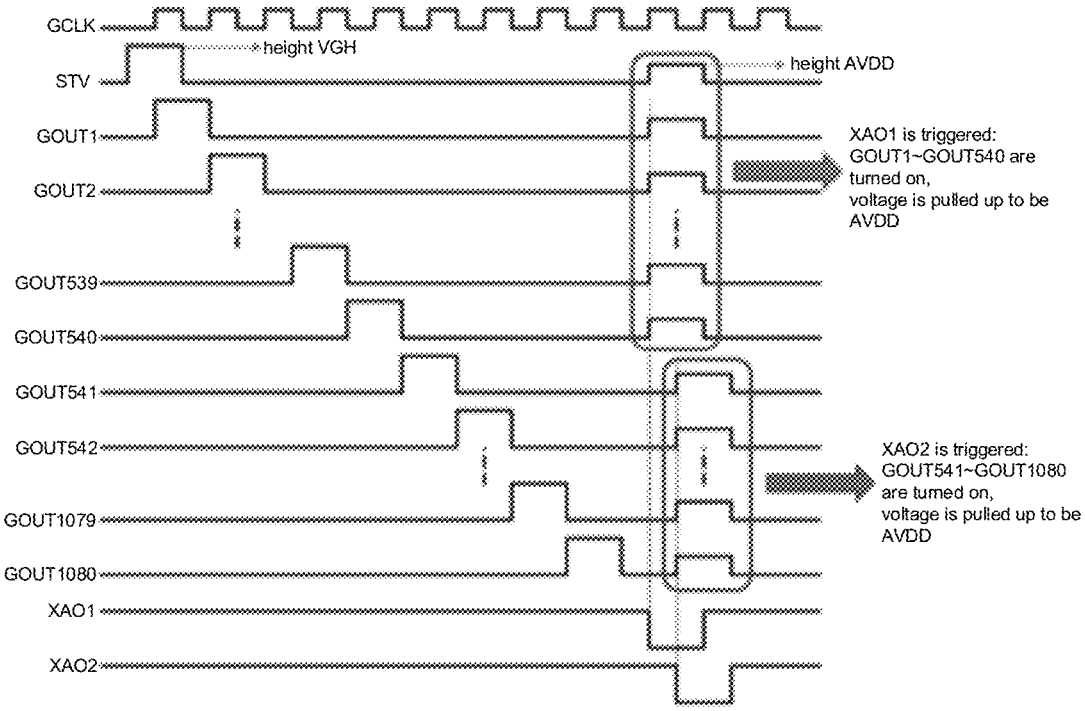
FIG. 5 is a timing diagram of signals outputted by a gate driving circuit of a display device according to some embodiments of the present disclosure.

Reference is made to FIG. 5, which is a timing diagram of signals outputted by a gate driving circuit of a display device according to some embodiments of the present disclosure. In the embodiments of the present disclosure, the display region of the display device is divided into two sub-regions, and each of the sub-regions includes 540 gate lines. The signals in FIG. 5 are briefly described below. GCLK represents a clock signal, STV represents a frame synchronization panel control signal, GOUT1 to GOUT1080 represent voltage signals inputted into the gate lines respectively by the gate driving circuit, and XAO1 and XAO2 represent control signals, which are generated by the gate driving circuit, and configured to control the gate lines in the sub-regions to be turned on when the display device is shut down or powered down. Specifically, the control signal XAO1 is configured to control the voltage signals GOUT1 to GOUT540 to be turned on, and the control signal XAO2 is configured to control the voltage signals GOUT541 to GOUT1080 to be turned on.

It can be seen from FIG. 5, when the display device displays an image normally, the gate driving circuit sequentially inputs the voltage VGH to each of the gate lines, so as to control each of the gate lines to be sequentially turned on. When the display device is shut down or powered down, the gate driving circuit generates the control signal XAO1 to control the voltage signals GOUT1 to GOUT540 to be turned on and pull up the voltage inputted to the voltage signals GOUT1 to GOUT540 to be the Voltage AVDD. After generating the control signal XAO1 for a predetermined interval, the control signal XAO2 is generated to control the voltage signals GOUT541 to GOUT1080 to be turned on and pull up the voltage inputted to the voltage signals GOUT541 to GOUT1080 to be the Voltage AVDD. Since the gate lines are turned on sequentially according to the sub-regions where the gate lines are located, an inrush current generated by the gate driving circuit becomes smaller, and thereby preventing the gate driving circuit from being burned down.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

The above are merely the preferred embodiments of the present disclosure. A person skilled in the art may make further modifications and improvements without departing from the principle of the present disclosure, and these modifications and improvements shall also fall within the scope of the present disclosure.

What is claimed is:

1. A display method for a display device, wherein the display device comprises a plurality of gate lines and a plurality of data lines, each of the gate lines extends in a row direction, each of the data lines extends in a column direction, and the display method comprises:

dividing a display region of the display device into a plurality of sub-regions, wherein each of the sub-regions comprises all of the data lines in the row direction, and comprises at least one of the gate lines in the column direction;

controlling, in the case that the display device is shut down or powered down, a gate driving circuit of the display device to input a turn-on voltage to the gate lines in each of the sub-regions one by one, wherein the turn-on voltage is simultaneously inputted into each of the gates lines in a same sub-region; and controlling, when the gate driving circuit of the display device is controlled to input the turn-on voltage to the gate lines in each of the sub-regions one by one in the case that the display device is shut down or powered down, a source driving circuit of the display device to input a voltage corresponding to a grayscale value of 0 to each of the data lines;

wherein the number of the gate lines in any one of the sub-regions is different from the number of the gate lines in any other one of the sub-regions.

2. The display method according to claim 1, wherein the turn-on voltage is equal to another turn-on voltage, and the other turn-on voltage is inputted into the gate lines by the gate driving circuit in the case that the display device displays an image normally.

3. The display method according to claim 1, wherein the turn-on voltage is less than another turn-on voltage, and the other turn-on voltage is inputted into the gate lines by the gate driving circuit in the case that the display device displays an image normally.

4. The display method according to claim 3, wherein the turn-on voltage is a supply voltage of a chip of a driver integrated circuit.

5. The display method according to claim 1, wherein the gate driving circuit is controlled to input the turn-on voltage to the sub-regions at different time intervals.

6. The display method according to claim 1, wherein the turn-on voltage is sequentially inputted into the gate lines of the sub-regions from top to bottom.

7. The display method according to claim 1, wherein the turn-on voltage is sequentially inputted into the gate lines of the sub-regions from bottom to top.

8. A display device, comprising: a plurality of gate lines and a plurality of data lines, wherein each of the gate lines extends in a row direction, each of the data lines extends in a column direction, and the display device further comprises:

a dividing circuit configured to divide a display region of the display device into a plurality of sub-regions, wherein each of the sub-regions comprises all of the data lines in the row direction, and comprises at least one of the gate lines in the column direction;

a first controlling circuit configured to control, in the case that the display device is shut down or powered down, a gate driving circuit of the display device to input a turn-on voltage to the gate lines in each of the sub-regions one by one, wherein the turn-on voltage is simultaneously inputted into each of the gates lines in a same sub-region; and a second controlling circuit configured to control, when the gate driving circuit of the display device is controlled to input the turn-on voltage to the gate lines in each of the sub-regions one by one in the case that the display device is shut down or powered down, a source driving circuit of the display device to input a voltage corresponding to a grayscale value of 0 to each of the data lines;

wherein the number of the gate lines in any one of the sub-regions is different from the number of the gate lines in any other one of the sub-regions.

9. The display device according to claim 8, wherein the turn-on voltage is equal to another turn-on voltage, and the other turn-on voltage is inputted into the gate lines by the gate driving circuit in the case that the display device displays an image normally.

10. The display device according to claim 8, wherein the turn-on voltage is less than another turn-on voltage, and the other turn-on voltage is inputted into the gate lines by the gate driving circuit in the case that the display device displays an image normally.

11. The display device according to claim 10, wherein the turn-on voltage is a supply voltage of a chip of a driver integrated circuit.

12. The display device according to claim 8, wherein the first controlling circuit is arranged in a chip of a driver integrated circuit, or arranged in a gate driving circuit that is in a form of a Gate driver On Array (GOA) circuit.

13. The display device according to claim 8, wherein the first controlling circuit is configured to control, in the case that the display device is shut down or powered down, the gate driving circuit of the display device to sequentially input the turn-on voltage into the gate lines of the sub-regions from top to bottom.

14. The display device according to claim 8, wherein the first controlling circuit is configured to control, in the case that the display device is shut down or powered down, the gate driving circuit of the display device to sequentially input the turn-on voltage into the gate lines of the sub-regions from bottom to top.

* * * * *